US005540049A

United States Patent [19]

Lunzman

[11] Patent Number: 5,540,049

[45] Date of Patent: Jul. 30, 1996

[54] CONTROL SYSTEM AND METHOD FOR A HYDRAULIC ACTUATOR WITH VELOCITY AND FORCE MODULATION CONTROL

[75] Inventor: Stephen V. Lunzman, Chillicothe, Ill.

[73] Assignee: Caterpillar Inc., Peoria, Ill.

[21] Appl. No.: 510,019

[22] Filed: Aug. 1, 1995

[51] Int. Cl.[6] ..... F16D 31/00; F16D 31/02

[52] U.S. Cl. ..... 60/327; 60/468

[58] Field of Search ..... 60/431, 433, 434, 60/468, 494, 327

[56] References Cited

U.S. PATENT DOCUMENTS

| | | | |
|---|---|---|---|
| 4,164,167 | 8/1979 | Imai et al. | 91/363 |
| 4,474,104 | 10/1984 | Creffield | 91/497 |
| 4,937,512 | 6/1990 | Takagi | 318/621 |
| 4,967,557 | 11/1990 | Izumi et al. | 60/423 |
| 5,074,194 | 12/1991 | Hirata et al. | 60/327 X |
| 5,077,974 | 1/1992 | Kamikawa et al. | 60/468 X |
| 5,079,492 | 1/1992 | Takagi | 318/621 |
| 5,170,625 | 12/1992 | Watanabe et al. | 60/452 |
| 5,249,421 | 10/1993 | Lunzman | 60/422 |
| 5,251,440 | 10/1993 | Bong-Dong et al. | 60/431 X |
| 5,267,441 | 12/1993 | Devier et al. | 60/452 |
| 5,295,353 | 3/1994 | Ikari | 60/468 X |
| 5,303,551 | 4/1994 | Lee | 60/431 |
| 5,305,681 | 4/1994 | Devier et al. | 91/361 |
| 5,355,675 | 10/1994 | Mayhugh et al. | 60/494 X |
| 5,394,697 | 3/1995 | Hirata | 60/468 X |

*Primary Examiner*—Hoang Nguyen
*Attorney, Agent, or Firm*—Thomas J. Bluth; James R. Yee

[57] ABSTRACT

Apparatus and method for controlling at least one hydraulic actuator by the hydraulic fluid discharged by a variable displacement hydraulic pump through a closed-center valve and a separate bypass valve. The apparatus receives a mode signal and a stroke signal and responsively controls the output of the variable flow hydraulic pump with either velocity or force modulation control.

8 Claims, 3 Drawing Sheets

CONTROL SYSTEM AND METHOD FOR A HYDRAULIC ACTUATOR WITH VELOCITY AND FORCE MODULATION CONTROL

TECHNICAL FIELD

This invention relates to a control for a hydraulic actuator, and more particularly, to an apparatus and method which permits both open-center and closed-center system characteristics for a hydraulic actuator in a system utilizing a closed-center valve and a separate bypass valve arrangement.

BACKGROUND ART

Hydraulic systems are utilized in many forms of construction equipment such as hydraulic excavators, backhoe loaders, and end loaders. The equipment is usually mobile having either wheels or track and includes a number of hydraulically actuated devices such as hydraulic cylinders and motors. In most cases, hydraulic systems are controlled by a valve arrangement in which a hydraulic pump provides pressurized fluid to a plurality of valves each associated with a hydraulic cylinder or motor. As an operator manipulates control levers located in the operator's compartment, hydraulic valves are controllably opened and closed such that pressurized fluid is controllably directed to the desired cylinder or motor.

Known systems typically utilize a plurality of open-center control valves to controllably actuate the various hydraulic actuators on the machine. The open-center control valves permit the system to exhibit a variable response which is dependent upon the load on the actuator. Accordingly, with an open-center valve arrangement, the operator typically can control a combination of both the velocity and the force, or pressure, of the hydraulic cylinder. However, control, or modulation, of cylinder velocity with open center control valves is not consistent. This lack of consistent control manifests itself in the form of variable deadband and gain in actual operation.

One way to achieve constant and more predictable results with respect to velocity modulation is the utilization of a closed-center load sensing system. In a closed-center load sensing system the valve flow is independent of load pressure. Although this results in consistent velocity modulation it does not provide the ability to modulate or limit cylinder force. In such a system, the operator loses the sense or "feel" for the load.

It is desirable to have drive systems which can exhibit some characteristics of both open-center and closed-center systems in the form of velocity modulation control and force modulation control. The present invention is directed to overcoming one or more of the foregoing problems associated with known hydraulic control systems.

DISCLOSURE OF THE INVENTION

In one aspect of the invention, a hydraulic control system is provided. The hydraulic control system includes a hydraulic actuator, a closed center valve, a valve controller means, a separate bypass valve, a variable flow hydraulic pump, a sensor for sensing the pressure of the variable flow hydraulic pump, means for producing a mode signal having a first value corresponding to velocity modulation control and a second value corresponding to force modulation control, and a means for producing a valve stroke signal. The hydraulic control system further includes a pump controller means for receiving the mode signal, pump pressure signal, and the valve stroke signal, and producing a pump flow command signal.

In a second aspect of the invention, a method for controlling a hydraulic actuating system is provided. The method includes receiving a valve stroke signal, sensing the pressure of the variable flow hydraulic pump, producing a mode signal having a first value corresponding to velocity modulation control and a second value corresponding to force modulation control, and receiving the valve stroke signal and producing a pressure command signal according to pressure modulation maps. The method further includes receiving the mode signal, the pump pressure signal, the pressure command signal, and the valve stroke signal, and producing a pump flow command signal, and controlling the variable flow hydraulic pump in response no the pump flow command signal.

DETAILED DESCRIPTION OF A PREFERRED EMBODIMENT OF THE INVENTION

Figure 1:
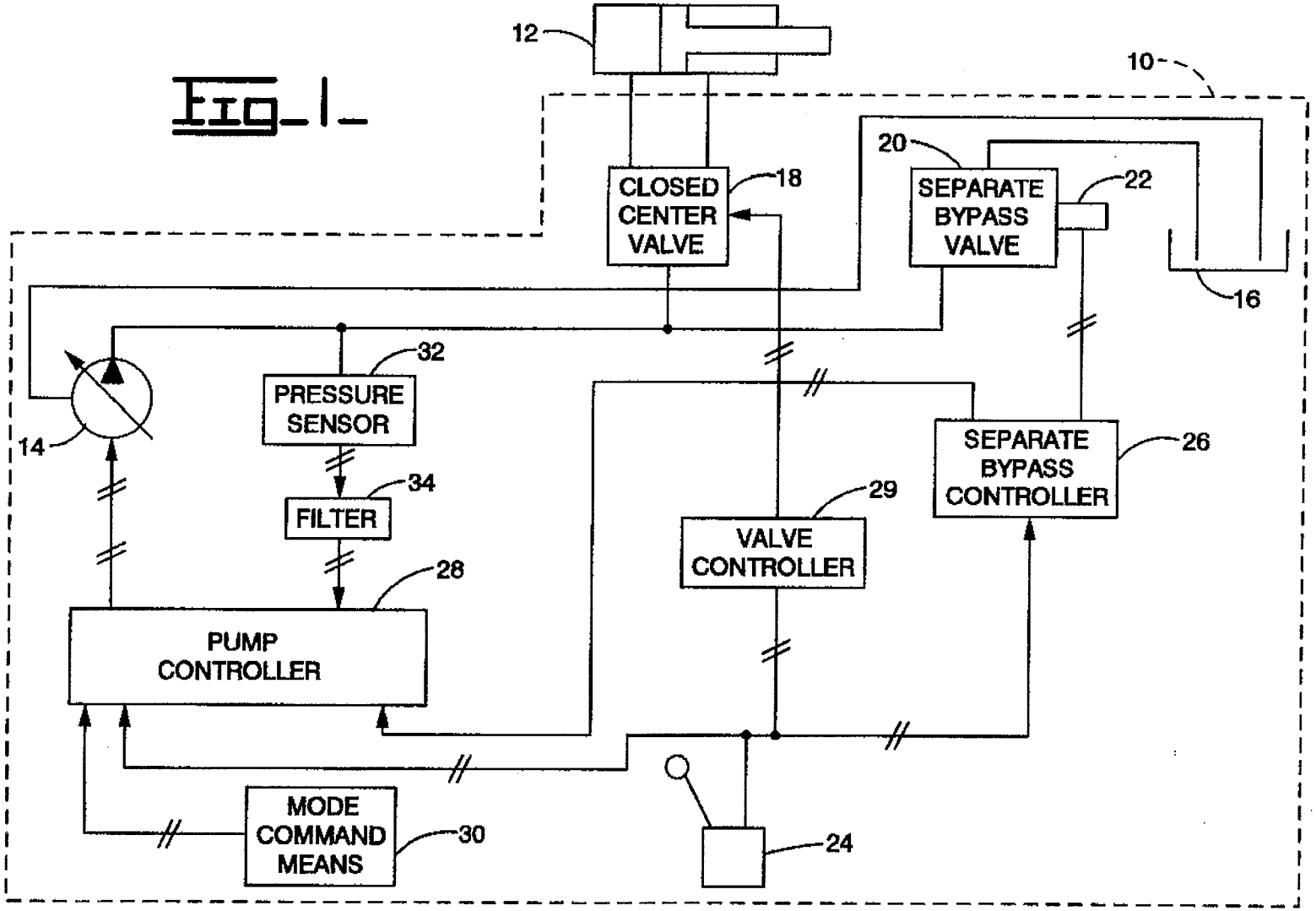
FIG. 1 is a block diagram of a control system for a hydraulic actuator.

As shown in FIG. 1., a hydraulic control system 10 is adapted to control at least one hydraulic actuator 12. For the purposes of illustration, the hydraulic actuator 12 is shown as a single hydraulic cylinder. However, other types of hydraulic actuators may be controlled by the hydraulic control system 10 including, inter alia, a rotary hydraulic actuator used to control the rotary motion of a hydraulic excavator. In addition, for simplicity, only one hydraulic actuator is depicted in FIG. 1. However, it is well known in the art to connect in series, or parallel, several hydraulic actuators.

The hydraulic control system 10 includes a variable flow hydraulic pump 14 for delivering fluid under pressure from a fluid reservoir 16 to the hydraulic actuator 12. A closed center control valve 18 is connected to the variable flow hydraulic pump 12 via a supply line and operates to control the flow of the hydraulic fluid to the hydraulic cylinder 12. The closed center control valve 18 may be actuated by a set of pilot valves (not shown).

The hydraulic control system 10 includes a separate bypass valve 20 which provides a single orifice to the fluid reservoir 16. The separate bypass valve 20 is actuated by a pilot valve 22. The hydraulic control system 10 is considered "open-center" due to the use of the separate bypass valve 20 in conjunction with the closed-center valve 18.

A stroke command means 24 produces at least one valve stroke signal which corresponds to the desired cylinder performance. The stroke command means 24 is responsive to operator input. For example, the hydraulic control system 10 can be used to control the movement of a particular implement on a construction machine. The operator manipulates control levers to move the implement to a particular position or at a particular velocity which corresponds to a particular cylinder position. The stroke command means 24 may include an operator handle associated with the hydraulic actuator 12. Although not depicted in FIG. 1, there may be multiple operator handles, each being associated with a different hydraulic actuator. The stroke command means 24 operates to translate the position of the operator lever into a particular valve stroke signal which is a function of the position of the operator lever. The valve stroke signal, produced by the stroke command means 24, is delivered to a separate bypass controller 26, a pump controller 28, and a valve controller 29. The valve controller 29 receives the valve stroke signal from the stroke command means 24 and responsively controls the closed-center valve 18.

A mode command means 30 produces a mode signal. The mode command means 30 is actuated by an operator and determines the mode of operation of the hydraulic control system 10. The mode command means 30 may also be automatic and responsive to varying system parameters or conditions such as, inter alia, a change from manual control to an automated digging cycle. The mode signal indicates whether or not the hydraulic control system 10 is to operate under velocity or force modulation control.

The separate bypass controller 26 receives the valve stroke signal from the stroke command means 24. The separate bypass controller 26 may also receive other valve stroke signals associated with different operator handles. In response to the valve stroke signal, the separate bypass controller 26 responsively controls the separate bypass valve by delivering an appropriate signal to the pilot valve 22 which actuates the separate bypass valve 20.

In a typical open-center valve system, the hydraulic pump has a feeder line to all of the valves, and outputs a flow of hydraulic fluid through the open center passage. Each of the spools has a different metering area with respect to the path to the hydraulic actuator.

In the preferred embodiment shown in FIG. 1, the operator activates the stroke command means 24 and at least one valve stroke signal is delivered to the separate bypass controller 26. The separate bypass controller 26 calculates the effect of the valve stroke signal, or multiple valve stroke signals, and derives a single value and signal that reproduces the effect of the multiple valves or spools in an open-center valve arrangement with the separate bypass valve 20. The signal controlling the separate bypass valve 20 can be derived by the use of look-up tables. However, in the preferred embodiment, the separate bypass controller 26 utilizes pressure modulation maps to calculate and derive the signal controlling the separate bypass valve 20.

Pressure modulation maps determine pump pressure as a function of valve stroke command at minimum pump flow for each hydraulic actuator associated with the hydraulic control system 10. The pressure modulation maps are designed to provide control of maximum pump pressure in response to the operator's valve stroke command. The pressure modulation maps are digitized and entered into the separate bypass controller 26. When more than one operator handle, each associated with a different hydraulic actuator, is moved by the operator, the pressure maps associated with each control lever are summed to produce a pressure command signal which is delivered the pilot valve 22. The pilot valve 22, in turn, actuates the separate bypass valve 20.

A pump pressure sensor 32 is positioned in the hydraulic control system 10 to sense the pressure of the variable flow hydraulic pump 14 and generate a pump pressure signal. The pump pressure signal is delivered to a dynamic filter 34 to eliminate unwanted electrical noise. The dynamic filter 34 may include a plurality of low-pass filters.

The pump controller 28 receives the valve stroke signal from the stroke command means 24, the mode signal from the mode command means 30, the pump pressure signal from pump pressure sensor 32 via the dynamic filter 34, and the pressure command signal from the separate bypass controller 26. The pump controller 28 produces a pump flow signal. The pump flow signal controls the output of the variable flow hydraulic pump 14.

When the mode signal has a value corresponding to velocity modulation pump controls the pump pressure signal from the pump pressure sensor 32 and the pressure command signal from the separate bypass controller 26 are disregarded by the pump controller 28. The pump controller 28 derives the pump flow signal as a function of the valve stroke signal.

Figure 2A:
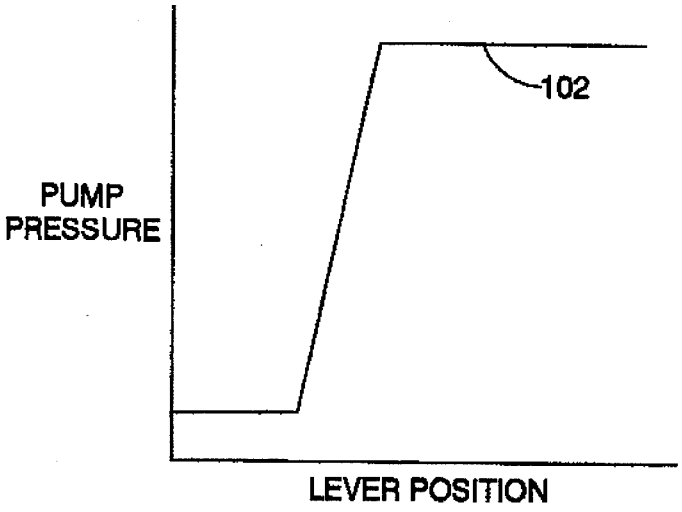
FIG. 2A is a graph illustrating the pump pressure characteristics of the hydraulic control system of FIG. 1 under velocity modulation control, according to an embodiment of the present invention.
Figure 2B:
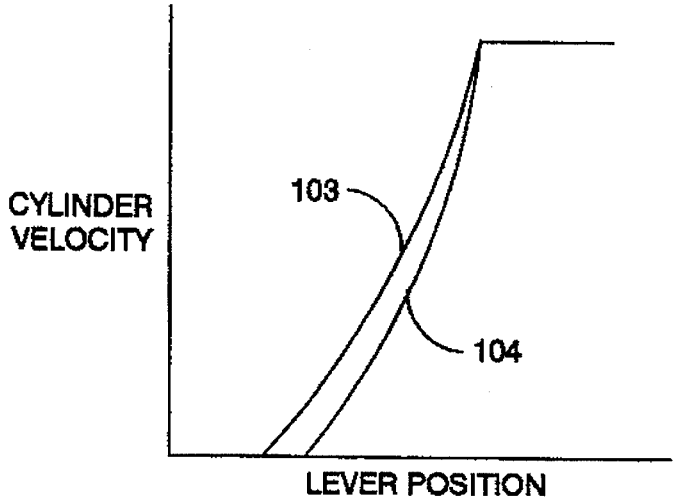
FIG. 2B is a graph illustrating the cylinder velocity characteristics of the hydraulic control system of FIG. 1 under velocity modulation control, according to an embodiment of the present invention.
Figure 2C:
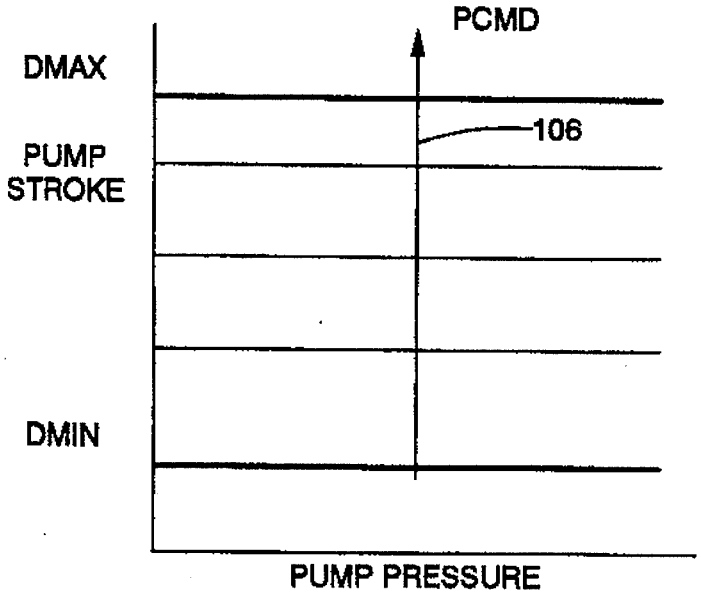
FIG. 2C is a graph illustrating the pump stroke characteristics of the hydraulic control system of the FIG. 1 under velocity modulation control, according to an embodiment of the present invention.

The control characteristics of the hydraulic control system 10 under the mode corresponding to velocity modulation control are depicted in FIGS. 2A, 2B, and 2C. With reference to FIG. 2A, the systems's flow characteristics are illustrated by a velocity modulation control pressure curve 102. The velocity modulation control pressure curve 102 illustrates that with velocity modulation control the hydraulic control system 10 exhibits poor pressure modulation when the hydraulic actuator 12 is stalled.

With reference to FIG. 2B, the system's velocity modulation is depicted by a velocity modulation control velocity curve for low pump pressure 103 and a velocity modulation control velocity curve for high pump pressure 104. Because the pump flow signal is not affected by pump pressure, the output of the variable flow hydraulic pump 14 is a function only of the valve stroke signal, i.e., the operator handles. As shown in FIG. 2B, there is a certain amount of deadband before velocity is realized.

FIG. 2C is a plot of pump stroke, versus pump pressure. Shown on FIG. 2C is a representative plot of a velocity modulation control pressure command curve 106. FIG. 2C depicts the fact that under velocity modulation control, pump flow is independent of pump pressure.

In the preferred embodiment, when the mode signal has a value corresponding to force modulation control, the pump controller 28 derives the pump flow signal as a function of the pressure command signal from the separate bypass controller 26 and the pump pressure signal from the pump pressure sensor 32. The pump controller may also implement force modulation control with the input of the valve stroke signal and the pump pressure signal without the pressure command signal. However, the pump controller 28 would then be programmed to derive a pressure command value from the valve stroke signal or multiple valve stroke signal in a similar fashion as described in connection with separate bypass controller 26.

Figure 3A:
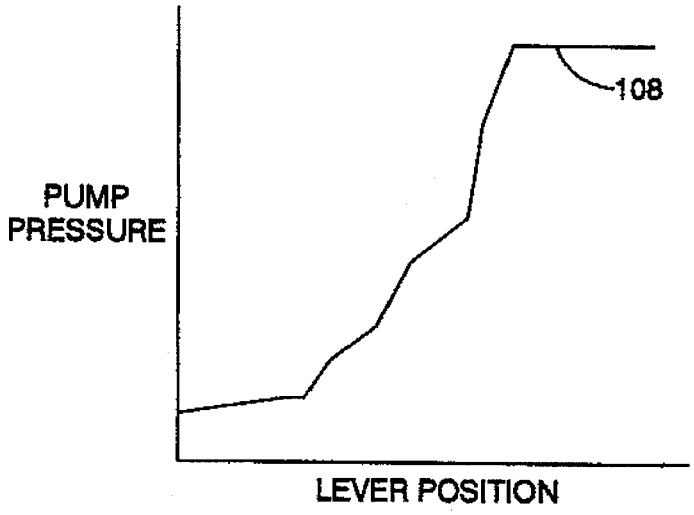
FIG. 3A is a graph illustrating the pump pressure characteristics of the hydraulic control system of FIG. 1 under force modulation control, according to an embodiment of the present invention.
Figure 3B:
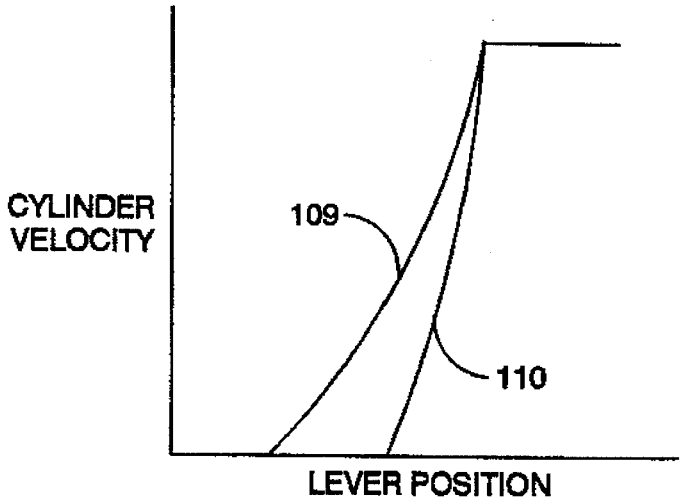
FIG. 3B is a graph illustrating the cylinder velocity characteristics of the hydraulic control system of FIG. 1 under force modulation control, according to an embodiment of the present invention.
Figure 3C:
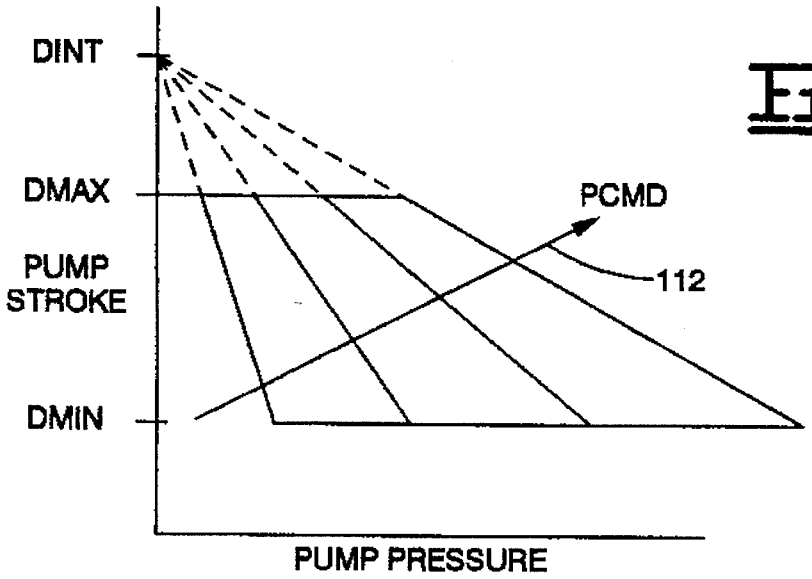
FIG. 3C is a graph illustrating the pump stroke characteristics of the hydraulic control system of the FIG. 1 under force modulation control, according to an embodiment of the present invention.

The control characteristics of the hydraulic control system 10 under the mode corresponding to force modulation control are depicted in FIGS. 3A, 3B, and 3C. With reference to FIG. 3A, the systems's flow characteristics are illustrated by a force modulation control pressure curve 108. The force modulation control pressure curve 108 illustrates that with force modulation control the hydraulic control system 10 exhibits good pressure modulation when the hydraulic actuator 12 is stalled.

With reference to FIG. 3B, the system's velocity modulation is depicted by a force modulation control velocity curves for low pump pressure 109 and a force modulation control velocity curve for high pump pressure 110. The pump flow signal is affected by pump pressure feedback and the pressure command signal which is derived from the valve stroke signal, i.e., the operator handles. As shown in FIG. 3C, there is a certain amount of deadband before velocity is realized. There is a significantly larger amount of deadband associated with force modulation control as shown in FIG. 3B when pump pressure is high, than associated with velocity modulation control as shown in FIG. 2B.

FIG. 3C is a plot of pump stroke versus pump pressure. Shown on FIG. 3C is a representative plot of a force modulation control pressure command curve (PCMD) 112. Also shown in FIG. 3C are DMIN which is the minimum pump displacement, DMAX which is the maximum pump displacement, and DINT which is the point at which the family of force modulation control pressure curves can be extrapolated to intercept. In the preferred embodiment, the pump controller 28 utilizes the following relationship during force modulation control:

$$DCMD=DINT*(1-PD/PCMD)$$

If DCMD>DMAX then DCMD=DMAX

If DCMD<DMIN then DCMD=DMIN where:

DCMD=Pump flow command value

DINT=Intercept Point (Constant)

PD=Pump Pressure

PCMD=Pressure command value

DMIN=Minimum pump displacement

DMAX=Maximum pump displacement

The pump controller 28 outputs a pump flow signal (DCMD) in accordance with above relationship. The pump controller 28 operates on different characteristic curves depending on the stroke command. The pump controller 28 causes the variable flow hydraulic pump 14 to deliver hydraulic fluid to the closed center control valve 18 in accordance with DCMD to operate the hydraulic actuator 12.

Industrial Applicability

The hydraulic control system 10 is advantageously used in construction equipment such as hydraulic excavators, backhoe loaders and end loaders. With reference to the drawings and in operation, the present invention, including the hydraulic control system 10 is adapted to controllably operate a hydraulic actuator 12 utilizing velocity and force modulation control in a system with at least one closed-center valve 18 and a separate bypass valve 20.

An operator selects the desired mode of operation through the mode command means 30. When the operator requires good pressure modulation, the force modulation control mode is selected. The force modulation control mode allows the operator to "feel" the load. On the other hand, if the operator requires good modulation of cylinder velocity, the velocity modulation control mode is selected. The velocity modulation control mode eliminates a significant amount deadband in the response.

Other aspects, objects, and advantages of this invention can be obtained from a study of the drawings, the disclosure, and the appended claims.

We claim:

1. A hydraulic control system, comprising:

a hydraulic actuator;

a closed center valve adapted to regulate the flow of pressurized hydraulic fluid to said hydraulic actuator;

a separate bypass valve adapted to regulate the flow of hydraulic fluid to tank;

a variable flow hydraulic pump adapted to provide pressurized hydraulic fluid through said closed center control valve to said hydraulic actuator as a function of a pump flow command signal;

a sensor for sensing the pressure of said variable flow hydraulic pump and producing a pump pressure signal;

means, responsive to an operator, for producing a mode signal, said mode signal having a first value corresponding to velocity modulation control and a second value corresponding to force modulation control;

means for producing a valve stroke signal corresponding to the desired performance of said hydraulic actuator;

valve controller means for receiving said valve stroke signal and responsively controlling said closed center valve;

separate bypass controller means for receiving said valve stroke signal and responsively controlling said separate bypass valve; and pump controller means for receiving said mode signal, said pump pressure signal, and said valve stroke signal, said pump controller means producing said pump flow command signal, said pump flow command signal being a function of said valve stroke signal to provide velocity modulation control when said mode signal has said first value, said pump flow command being a function of said valve stroke signal and said pump pressure signal to provide force modulation control when said mode signal has said second value.

2. A hydraulic control system, as set forth in claim 1, wherein said means for producing a stroke signal includes an operator control lever.

3. A hydraulic control system, as set forth in claim 1, including means for filtering said pump pressure signal.

4. A hydraulic control system, comprising:

a hydraulic actuator;

a closed center valve adapted to regulate the flow of pressurized hydraulic fluid to said hydraulic actuator;

a separate bypass valve adapted to regulate the flow of hydraulic fluid to tank;

a variable flow hydraulic pump adapted to provide pressurized hydraulic fluid through said closed center control valve to said hydraulic actuator as a function of a pump flow command signal;

a sensor for sensing the pressure of said variable flow hydraulic pump and producing a pump pressure signal;

means, responsive to an operator, for producing a mode signal, said mode signal having a first value corresponding to velocity modulation control and a second value corresponding to force modulation control;

means for producing a valve stroke signal corresponding to the desired performance of said hydraulic actuator;

valve controller means for receiving said valve stroke signal and responsively controlling said closed center valve;

separate bypass controller means for receiving said valve stroke signal and responsively controlling said separate bypass valve, said separate bypass controller means producing a pressure command signal according to pressure modulation maps; and pump controller means for receiving said mode signal, said pump pressure signal, said pressure command signal and said valve stroke signal, said pump controller means producing pump flow command signal, said pump flow command signal being a function of said valve stroke signal to provide velocity modulation control when said mode signal has said first value, said pump flow command being a function of said pressure command and said pump pressure signal to provide force modulation control when said mode signal has said second value.

5. A hydraulic control system, as set forth in claim 4, wherein said means for producing a stroke signal includes an operator control lever.

6. A hydraulic control system, as set forth in claim 4, including means for filtering said pump pressure signal.

7. A method for controlling a hydraulic actuating system, the hydraulic actuating system including a variable displacement hydraulic pump, a closed-center control valve, a separate bypass valve, a hydraulic actuator, and a microprocessor, the method comprising the steps of:

receiving a valve stroke signal associated with the desired performance of said hydraulic actuator and responsively controlling said closed center control valve;

sensing the pressure of said variable flow hydraulic pump and producing a pump pressure signal;

producing a mode signal in response to operator input, said mode signal having a first value corresponding to velocity modulation control and a second value corresponding to force modulation control;

receiving said valve stroke signal and responsively controlling said separate bypass valve and producing a pressure command signal according to pressures modulation maps;

receiving said mode signal, said pump pressure signal, said pressure command signal, and said valve stroke signal, and producing a pump flow command signal, said pump flow command signal being a function of said valve stroke signal to provide velocity modulation when said mode signal has said first value, said ,pump flow command being a function of said pressure command and said pump pressure signal to provide force modulation control when said mode signal has said second value; and controlling said variable flow hydraulic pump in response to said pump flow command signal.

8. A method, as set forth in claim 7, including the step of filtering said pump pressure signal.

* * * * *